United States Patent [19]

Kotschak et al.

[11] 4,119,234

[45] Oct. 10, 1978

[54] VACUUM-TIGHT WINDOWS FOR PASSAGE OF X-RAYS OR SIMILAR PENETRATING RADIATION

[75] Inventors: Otto Kotschak, Erlangen-Buckenhof; Richard Frank, Erlangen, both of Germany

[73] Assignee: Siemens Aktiengesellschaft, Berlin & Munich, Germany

[21] Appl. No.: 669,725

[22] Filed: Mar. 23, 1976

[30] Foreign Application Priority Data

Mar. 27, 1975 [DE] Fed. Rep. of Germany ..... 2513894

[51] Int. Cl.[2] ..... H01J 35/18

[52] U.S. Cl. ..... 220/2.1 R; 313/59; 313/420

[58] Field of Search ..... 220/2.1 R, 2.1 A, 2.3 A; 313/55–60, 420, 478–482; 250/213 VT, 505, 506, 526

[56] References Cited

U.S. PATENT DOCUMENTS

| | | | |
|---|---|---|---|
| 1,517,322 | 12/1924 | Templin | 250/505 X |
| 2,187,126 | 1/1940 | Kern et al. | 313/420 |
| 2,222,197 | 11/1940 | Engels | 220/2.3 A X |
| 2,820,168 | 1/1958 | Stiff | 313/420 |
| 3,828,190 | 8/1974 | Dahlin et al. | 250/505 X |
| 3,878,417 | 4/1975 | Eberlein | 313/59 |

FOREIGN PATENT DOCUMENTS

| | | | |
|---|---|---|---|
| 618,811 | 7/1947 | United Kingdom | 313/420 |
| 829,695 | 3/1960 | United Kingdom | 313/59 |
| 1,103,563 | 2/1968 | United Kingdom | 250/505 |

*Primary Examiner*—Stephen Marcus

*Attorney, Agent, or Firm*—Hill, Gross, Simpson, Van Santen, Steadman, Chiara & Simpson

[57] ABSTRACT

A vacuum-tight window construction for the passage of X-ray and similar penetrating radiation, the edge of the window having the shape of a tube and being tightly secured with a tube-shaped frame. The connection between the window and the frame is effected by a press-fit combination of three tube-shaped parts one into the other. One part is the tubular edge of the window, the second part is the edge of the frame, and the third part is an additional ring, the materials being selected such that the coefficient of thermal expansion of the outermost part is lower than that of the part disposed in the middle, and that of the innermost part is at least equal to that of the outermost part and less than that of the center part. The outermost and innermost parts can be composed of steel, and the middle part of pure or alloyed aluminum.

9 Claims, 2 Drawing Figures

VACUUM-TIGHT WINDOWS FOR PASSAGE OF X-RAYS OR SIMILAR PENETRATING RADIATION

FIELD OF THE INVENTION

The present invention relates to windows provided with a vacuum-tight frame and intended for permitting the passage of X-rays or similar penetrating radiation.

BACKGROUND OF THE INVENTION

Windows of this type are known in connection with X-ray tubes, i.e. high vacuum tubes, serving as the source of radiation, in order to permit the X-rays produced in such tubes to be transmitted through the vacuum-tight wall with as little loss as possible. Windows permitting such passage are also needed in connection with tubes in which X-rays, or similar penetrating radiation of isotopes such as, for example, gamma rays, are to be converted into signals for further registration. Such tubes, in particular, must be vacuum-tight if conversion into electrons is intended, or if the converting elements such as, for example, photoelectric cathodes containing alkali metals, are sensitive to atmospheric influences. Tubes of this type may, for example, contain measuring probes for producing electrical measuring signals, or they may contain apparatus suitable for converting the rays into optical or electrical signals, from which a visible image may then be obtained. Such tubes are known, for example, as picture-forming or image-converting tubes, television tubes and the like.

The known tubes comprise metal windows which permit X-rays, gamma rays and the like to be passed through such windows. Such windows are therefore often composed of beryllium (Be) which is rather permeable to such rays. These known beryllium window plates are combined with the housing or shell of the tube by means of soldering or welding, including the use of an intermediate arrangement of connecting elements (see U.S. Pat. No. 3,419,741, and British Pat. No. 978 878). However, in the present state of the art, beryllium window plates are not available in any size or shape. Moreover, the shaping of beryllium poses many problems. However, for many purposes of the application of X-ray windows, for example, for use in X-ray picture amplifiers, a large diameter and freedom of shaping limitations are needed in addition to the availability of an economically justifiable material. It is for this reason that in vacuum picture amplifiers, the windows are currently still prepared from glass, although this material absorbs X-rays to a substantial extent.

It has also been attempted to use thin foils of titanium as the material of windows permitting the passage of radiation (see U.S. Pat. No. 3,878,417). The problem of securing these thin foils is resolved by enclosing the metal foil in a stable frame which, for example, may be prepared from steel. Such a frame has the shape of a ring; the marginal portions of the ring, or frame, and the ones of the foil are fused together. However, if vacuum tubes are used, the thin foil is sucked into the inner space of the chamber, which makes it necessary to design the chamber with lengths greater than those usually provided for outwardly curved windows for image amplifiers.

It was also not possible to successfully employ foils which were entirely made of aluminum, thus of a light metal, or alloy. No satisfying way was hitherto found in which electric transmissions could be conducted through a wall of aluminum in a manner that would be accesptable in practical applications.

It is known also to weld disks of light metal into a heavy metal frame, whereby it is possible to obtain in a simple manner disks even with large diameters, which may then be shaped or formed in any desired way (see U.S. Pat. Application 607,874). This method comprises the use of a disk composed of light metals or alloys other than beryllium, and coating or cladding the light metal along its marginal edges with a fusible heavy material, which coating or cladding is subsequently fused tight with the frame. One of the embodiments of the above type comprises fitting the edges of the window plate axially and outwardly flanged into a ring-shaped frame, and subsequently fusing together the edges of the tubular flange and the tubular frame.

When studying the problem here in question, it was found that it may be advantageous if the window plates could be secured without involving a heating step, i.e. without the heating required in a welding or soldering operation. For example, by not using any additional agents such as, for example, solder or adhesive, it could perhaps be avoided that fluxing agents or binders and hardening agents would later give off gas and be damaging to the high vacuum.

SUMMARY OF THE INVENTION

It is an object of the present invention to provide a method by which disks or plates of the aforestated type comprising a large diameter may be inserted in vacuum tight fashion without any fusion by welding, in a window structure that permits the passage of radiation.

This object is achieved by combining the window plate with the frame as a tightly fitting combination of three tubular parts which are press fitted one into the other. Of said three parts, one part is a tube-shaped marginal portion of a window, the second part is an edge of the frame, and the third part is an additional ring, the materials of said parts being selected in such a way that the coefficient of thermal expansion of the outer part is lower than that of the part disposed in the middle, and the coefficient of thermal expansion of the innermost part is at least equal to that of the outermost part and less than that of the middle part.

According to the present invention, it is possible to produce inlet windows, for example, in the form of caps, from inexpensive materials such as, for example, aluminum or its alloys, though also beryllium and its alloys may be used. However, it is also possible to use other materials, such as, plastic materials, for example, polyimides, provided such materials sufficiently permit the passage of rays while being sufficiently stable in a high vacuum. Materials of said type are known to be commonly used as construction materials, and are, therefore, available in any desired size and may be shaped in any desired way. Windows may thus be prepared also with an outwardly curved shape, so that shapes are achievable which are sufficiently stable and readily permeable by radiation.

According to the invention, it is also possible to attain the advantages offered by a heavy metal frame which may form the transition to a glass or heavy metal tube. However, the tube may also be entirely composed of a metal such as iron, steel, nickel, copper etc. Any of said materials may be used as long as it is stable, or provides for a stable tube in high vaccum, and as long as it permits the manufacture of a sufficiently sturdy tube. Both the materials used for the tube and the window must satisfy one common requirement, namely a tight fit between the two parts upon pressing and, if required, heating.

The construction according to the present invention is realized without welding or soldering. This imparts the desired advantage that deformations of the frame and the like are avoided as they may occur when employing the usual methods of welding or soldering under heat. In contrast, the invention provides that all parts of the frame and window are combined with each other simultaneously during the fitting and subsequent pressing steps and, if needed, a heating step to 400° to 500° C., so that thermal or mechanical forces will occur uniformly in all parts, whereby the risk of distortions or warpage is avoided.

It is a feature of the present invention that a gap is formed between two outer tube-shaped parts of sufficient stability, and that said gap remains at least substantially unchanged or is reduced during heating. Into said gap, a part is placed whose coefficient of expansion is higher than that of the outer part, whereby it is achieved that during heating, the part with the higher coefficient of expansion disposed between the other tubular parts is pressed under very high pressure against the walls of said other parts. This results in a tight combination with said other parts without requiring any soldering or adhesive agents. In addition to the materials expressly described previously, it is possible to use all materials which upon being pressed together will result in an integrated assembly that is sufficiently stable for the intended purpose. In addition to metals, such materials may include metallized ceramic or similar materials. However, also plastic parts may be used provided an intimate bonding is achieved after pressing such parts together.

In a known combination of parts of different coefficients of thermal expansion (metal or ceramic parts) enclosing each other and joined by soldering or with adhesive and the like, it was intended to avoid difficulties, particularly, in the brazing of metal and ceramic material parts with diameters in excess of 30 mm by surrounding the part having the higher coefficient of heat expansion with a wound layer of a mechanically stronger (thicker) material having a lower coefficient of thermal expansion, or by providing an arrangement in which a mechanically stronger (thicker) part having a higher coefficient of thermal expansion is placed against the inner part. The coefficient of thermal expansion of the additional part should preferably be equal to that of the ceramic material, so that a press fit - or force fit - between these parts will also be guaranteed during the soldering step. However, such combinations require the use of a binder, for example, a soldering agent, adhesive agent or the like. Furthermore, it is known today that parts combined in the above manner are not suitable for high vacuum tubes as used in the field of cathode-ray technology, because the solder and also the adhesive will release gas (after generation) for a long time.

In one embodiment of the invention, a window which is sealed and vacuum-tight and permeable to X-ray and gamma radiation, and to be used, for example, in association with a picture amplifier is obtained by making the inlet side of the vacuum tube of a picture amplifier, or the entire tube, from steel, and by making the inlet or input window in the form of a cap composed of aluminum, said cap fitting over the outer edge of the inlet aperture of the picture amplifier. A steel ring composed of the same material as said tube is fitted externally over the edge of said cap. Solely by fitting or pressing said parts together one marginally on top of the other, a tightly fitting seal of said cap on the inlet of the tube is achieved according to the present invention.

When using steel and aluminum, the ratio of the coefficients of thermal expansion of these two materials can be expressed as 1:2. For tubes having an inlet aperture diameter of 30 cm or more, it is useful to use a high-grade steel for the tube wall. Sufficient strength is obtained if the wall thickness is about 2 mm, and the diameter from 35 to 40 cm. In such an arrangement, an aluminum window with a thickness of 1 mm is sufficiently stable and sufficiently permeable to penetrating rays. A ring of steel having a thickness of 2 mm lends sufficient support to the outer circumference. Furthermore, the cap should extend for about 2 to 3 cm over the edge of the tube inlet aperture. The steel ring should have a width of from 3 to 5 cm. By selecting the above dimensions, good stability is achieved and also sufficient contact area is obtained between the parts. The ring is fitted in a press having a pressing pressure of about 500 kp to 1000 kp. Usefully, a heating step should follow with heating to a temperature of from 400° to 500° C. in order to insure absolute tightness.

The fitting of said ring is simpler if the outer surface of the tube is provided with a conical shape to conform with the edge of the cap and the inside surface of the ring, whereby matching surfaces are initially provided to obtain a seating of the parts that is true to size. Furthermore, the sealing or tightness may be further enhanced by providing the outer edge of the tube, i.e. the surface on which the cap is seated, with a circumferential bead or the like which extends parallel to said outer edge of the tube. When the parts are integrally assembled said bead will be pressed or forced into the material of the window, thereby improving the locking engagement. As a rule, a single bead is sufficient. As seen in radial section, such a bead may have a triangular or rectangular shape; however, other shapes may be usable, for example, a semicircular form. Whatever shape is used, the only matter of importance is that a tight connection is formed by pressing such a projection into the material.

Details and advantages of the present invention will follow from the description of the embodiments shown in the figures in the drawing.

DETAILED DESCRIPTION OF DRAWING

Figure 1:
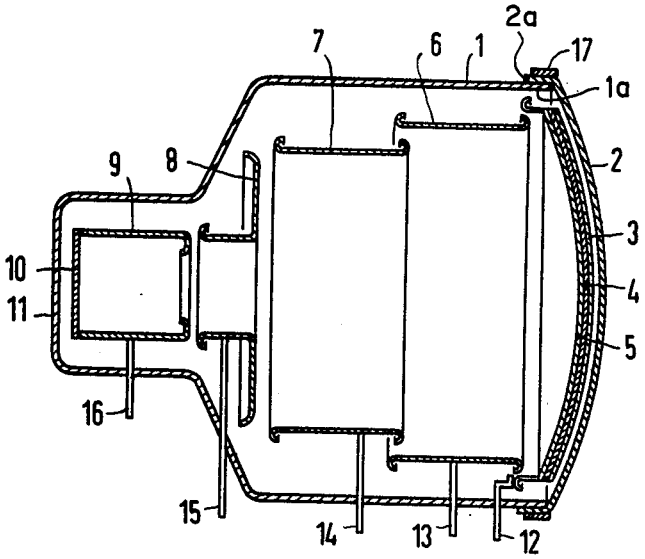
FIG. 1 is a sectional, elevational view of a vacuum X-ray picture amplifier provided with a window according to the invention.

In FIG. 1, reference number 1 designates a vacuum-tight tube sealed at one end by a cap-shaped inlet window 2 composed of aluminum. The tube 1 includes an annular frame with a tubular edge portion 1*a* for receiving an annular flange 2*a* of window 2. At the rear of window 2, there is disposed an aluminum support means which is provided with a fluorescent coating 4 and a photo-cathode layer 5. This combination, which represents the actual photo-cathode, is followed by electrodes 6, 7, 8 and 9, and a luminous screen 10 to which electrons are sensitive. The screen, in turn, is disposed in front of an optically transparent window 11 which represents the closure of tube 1 at the end opposite window 1. Electrodes 6 to 9 are conventional and serve the purpose of forming an image on luminous screen 10 of the electrons released in photo-cathodes 3 to 5. Electrodes 6 to 9 are connected, for this purpose, by feed lines 12 to 16 to a voltage source (not shown) for producing the respective potentials.

Figure 2:
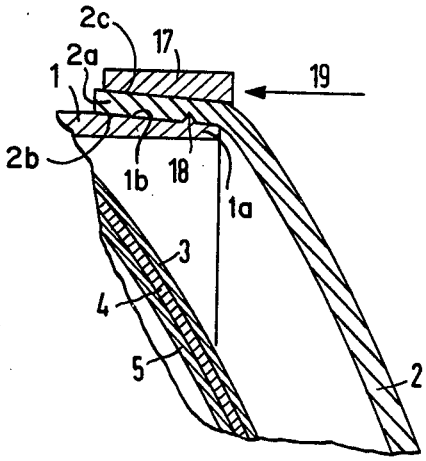
FIG. 2 shows on enlarged scale a portion of the connection of the window and the tube of the picture amplifier.

FIG. 2 shows that the cap-shaped inlet window 2 consisting of aluminum with a thickness of 2 mm has the form of a cap whose tubular rim or annular flange 2*a* extends over the outer end or tubular edge portion 1*a* of tube 1, with a ring 17 being placed around the outer circumference of the annular flange 2*a* of window 2. The ring 17 is made of the same steel as tube 1. The outer surface 1*b* of the tubular edge portion 1*a* of tube 1 is conical and is parallel to the conical inner and outer surfaces 2*b* and 2*c* of the rim or tubular annular flange 2*a* of window 2 and the conical inner surface of ring 17. As its outer surface, the tube 1 is provided with a circumferential bead, or projection 18, having a triangular shape, so that upon compression in the direction of arrow 19, a vacuum-tight seal is achieved on the conically matching surfaces of the tubular edge portion 1*a*, the tubular annular flange 2*a*, and the ring 17. To facilitate description of the present invention, surfaces 2*b* and 2*c* will be described as the "radially inner" and "radially outer" surfaces of the tubular annular flange 2*a*, so as to distinguish these surfaces as being inner and outer with respect to the radial direction extending from the center of curvature of the annular flange 2*a* radially outwardly. The term "encircle" is used in the sense of being directly radially outwardly of and encompassing.

What is claimed is:

1. A vacuum-tight window construction for the passage of x-ray and similar penetrating radiation, said construction comprising an annular frame having a tubular edge portion, a cap-shaped window transparent to penetrating radiation having an annular flange with radially inner and outer surfaces, and a ring, said ring, said annular flange and tubular edge portion being juxtaposed with one another and press-fit together to form an integral assembly, the outermost of the juxtaposed elements having a coefficient of thermal expansion which is less than that of the annular flange of the cap-shaped window which forms the middle juxtaposed element, the innermost of the juxtaposed elements having a coefficient of thermal expansion which is at least equal to that of the outermost element but less that that of the middle element, the innermost of the juxtaposed elements having an outer surface mating with the inner surface of the annular flange, the outermost element having an inner surface mating with the outer surface of the annular flange and encircling the annular flange of said window, the innermost element being encircled by both the outermost element and the annular flange of the window, and the elements being formed with sufficiently close tolerances and being forced together with sufficient pressure therebetween at the mating surfaces thereof to provide a tight press-fit relationship in the absence of any additional securing means.

2. A construction as claimed in claim 1 wherein said innermost and outermost elements are composed of steel and the middle element is pure or alloy aluminum.

3. A construction as claimed in claim 1 wherein the innermost element is the tubular edge portion of the frame, said annular flange of the window being the middle element, and said ring being the outermost element.

4. A construction as claimed in claim 3 wherein the innermost element has an outer conical surface and the outermost element has an inner conical surface.

5. A construction as claimed in claim 2 wherein at least one of the steel elements has a circumferential bead which penetrates into the aluminum element.

6. A construction as claimed in claim 5 wherein said bead has a triangular cross-section pointing outwardly.

7. A construction as claimed in claim 1 with the annular flange being of sheet material having an axial extent of at least two to three centimeters in overlapping relation to the tubular edge portion of said frame, and said annular flange having a vacuum-tight seal to said tubular edge portion of said frame solely by the press fit relationship of the engaging surfaces thereof.

8. A construction as claimed in claim 7 with the window including said annular flange being of sheet material having a thickness of about one millimeter.

9. A construction as claimed in claim 8 with the window providing an inlet aperture for penetrating radiation of at least about 30 centimeters in diameter and the sheet material of the window having a thickness of about one millimeter.

* * * * *